US009248494B2

(12) United States Patent
Lin

(10) Patent No.: US 9,248,494 B2
(45) Date of Patent: Feb. 2, 2016

(54) RIVET GUN HAVING BUFFER DEVICE

(71) Applicant: Yu-Tang Lin, New Taipei (TW)

(72) Inventor: Yu-Tang Lin, New Taipei (TW)

( * ) Notice: Subject to any disclaimer, the term of this patent is extended or adjusted under 35 U.S.C. 154(b) by 379 days.

(21) Appl. No.: 14/022,527

(22) Filed: Sep. 10, 2013

(65) Prior Publication Data

US 2015/0068003 A1 Mar. 12, 2015

(51) Int. Cl.

*B21J 15/22* (2006.01)
*B21J 15/10* (2006.01)
*B21J 15/04* (2006.01)

(52) U.S. Cl.

CPC ..... *B21J 15/22* (2013.01); *B21J 15/043* (2013.01); *B21J 15/105* (2013.01); *Y10T 29/53748* (2015.01)

(58) Field of Classification Search

CPC ..... B21J 15/16; B21J 15/18; B21J 15/20; B21J 15/22; B21J 15/043; B21J 15/105; Y10T 29/53739; Y10T 29/53743; Y10T 29/53748

See application file for complete search history.

(56) References Cited

U.S. PATENT DOCUMENTS 4,366,697 A * 1/1983 Leopold ..... B21K 1/02 72/360
4,431,172 A * 2/1984 Soda ..... B21D 28/20 267/119
4,479,601 A * 10/1984 Hara ..... B21J 15/041 227/130
4,580,435 A * 4/1986 Port ..... B21J 15/022 29/243.525
4,597,263 A * 7/1986 Corbett ..... B21J 15/022 29/243.525
4,815,310 A * 3/1989 Summerlin ..... B21J 15/105 29/243.523
4,878,372 A * 11/1989 Port ..... B21J 15/022 29/243.525
4,964,292 A * 10/1990 Kaelin ..... B21J 15/022 72/391.2
5,490,311 A * 2/1996 Rosier ..... B21J 15/043 29/243.523
6,978,526 B1 * 12/2005 Lin ..... B21J 15/105 29/243.523
8,707,530 B2 * 4/2014 Lin ..... B21J 15/043 29/243.521

* cited by examiner

*Primary Examiner* — Edward Tolan
(74) *Attorney, Agent, or Firm* — Rosenberg, Klein & Lee

(57) ABSTRACT

The rivet gun has a barrel, a handle, an inflator, a piston assembly and at least one buffer device. The piston assembly has a piston rod and a piston head. The at least one buffer device is mounted in the piston head and has a housing, a valve stem and a buffer spring. The housing has an inserting hole and a side hole communicating with the inserting hole. The inserting hole has a valve opening. The valve stem is movably mounted in the valve opening. A valve part is formed on a lower end of the valve stem to selectively close the valve opening. The buffer spring is mounted around the valve stem. When the piston head moves upward, the buffer spring absorbs some momentum produced by the high pressure gas to mitigate shake caused by the high pressure gas directly hitting the piston head.

14 Claims, 8 Drawing Sheets

RIVET GUN HAVING BUFFER DEVICE

BACKGROUND OF THE INVENTION

1. Field of the Invention

The present invention relates to a rivet gun and more particularly to a rivet gun having one or more buffer devices.

2. Description of Related Art

With reference to Taiwan patent application No. M400369, a rivet gun is used to rivet a rivet in two boards to fix the two boards together. A rivet usually has a head and a shaft connected to the head, and the shaft is usually longer than the head.

A rivet gun usually has a barrel, a handle, a trigger, an inflator and a piston assembly. The barrel has a rivet assembly mounted inside the barrel. The handle extends vertically and downwards from the barrel and has a gas channel formed in the handle. The trigger is mounted on the handle and connected to the gas channel. The inflator is mounted on a bottom of the handle and connected to the rivet assembly to actuate the rivet assembly by hydraulic pressure. In addition, the inflator can be connected to a high pressure gas source to inflate a high pressure gas into the barrel for ejecting a shaft of a rivet out of the barrel. The piston assembly is movably mounted in the inflator and has a piston rod and a piston head connected to the piston rod. A through hole is formed through the piston head through which an inserting tube is mounted. The inserting tube is connected to the bottom of the handle.

When the rivet gun is used to rivet a rivet, the rivet penetrates through two boards, and then the trigger is pulled. A head of the rivet abuts a front end of the barrel and is clamped by the rivet assembly. Meanwhile, the head of the rivet is pressed by the barrel and becomes T-shaped to fix the rivet on the boards. Simultaneously, the high pressure gas of the high pressure gas source is inflated into the barrel, a backward suction is formed and a section fractured from a shaft of the rivet is ejected out from a rear end of the barrel by the backward suction.

The piston head of the piston assembly of the rivet gun is disc-like and contacts an inner wall of the inflator in an air tight manner to divide an inner space of the inflator into an upper air chamber and a lower air chamber. However, the piston head is solid, thus, when the trigger is pulled for riveting, the high pressure gas inflates into the lower air chamber, such that the piston head moves upward. The piston head is suddenly pushed by the high pressure gas and shakes, and noise is produced by the piston head. On the contrary, when the riveting is finished, the piston head moves downward, but the lower air chamber still contains air, such that the piston head cannot move to a bottom of the inflator immediately.

SUMMARY OF THE INVENTION

The main objective of the invention is to provide a rivet gun having one or more buffer devices.

The rivet gun comprises a barrel, a handle, an inflator, a piston assembly and at least one buffer device. The barrel has a rivet assembly mounted in the barrel. The handle extends downwards from the barrel and has a trigger assembly to actuate the rivet assembly; an accommodating space is formed in the handle and a hydraulic pipe is mounted in the accommodating space and has a hydraulic channel formed in the hydraulic pipe. The inflator is mounted on a lower end of the hydraulic pipe and has an air chamber formed in the inflator. The piston assembly is mounted in the inflator, and has a piston rod and a piston head; the piston rod is movably mounted in the hydraulic channel of the hydraulic pipe; the piston head is disk-shaped and is mounted on a lower end of the piston rod, the piston head contacts an inner wall of the air chamber of the inflator in an air tight manner and divides the air chamber into an upper space and a lower space; at least one combining hole is formed through the piston head. The at least one buffer device is mounted in a corresponding combining hole of the piston assembly and has a housing, a valve stem and a buffer spring. The housing has an inserting hole and at least one side hole, the inserting hole is axially formed through the housing and has a valve opening, the at least one side hole is radially formed through the housing and communicates with the inserting hole. The valve stem is movably mounted in the inserting hole and has a valve part formed radially and outwards from a lower end of the valve stem to selectively close the valve opening. The buffer spring is sleeved on the valve stem and has two ends, one end of the buffer spring abuts an inner wall of the inserting hole and the other end abuts the valve part to open the valve opening in a default state of the rivet gun.

When the lower space is filled with high pressure gas, the piston head moves upward in the air chamber. The high pressure gas pushes the valve stem of the at least one buffer device upward and presses the buffer spring to close the valve opening of the housing by the valve part.

When the piston head moves downward in the air chamber, the valve stem of the at least one buffer device also moves downward to open the valve opening of the housing by the valve part and release the buffer spring, and further makes the upper space and the lower space communicate with each other.

By the above structure, the rivet gun in accordance with the present invention has the following advantages:

1. When the piston head moves upward, the high pressure gas filled in the lower space has to press the buffer spring to close the valve opening before pushing the piston head upward. The buffer spring absorbs some momentum produced by the high pressure gas to mitigate shake caused by the high pressure gas directly hitting the piston head.

2. When the piston head moves downward in the air chamber, the valve opening is opened and the buffer spring is released to make the upper space and the lower space communicate with each other, such that the gas can freely enter the upper space or the lower space to increase a moving smoothness of the piston head.

DETAILED DESCRIPTION OF THE PREFERRED EMBODIMENTS

Figure 1:
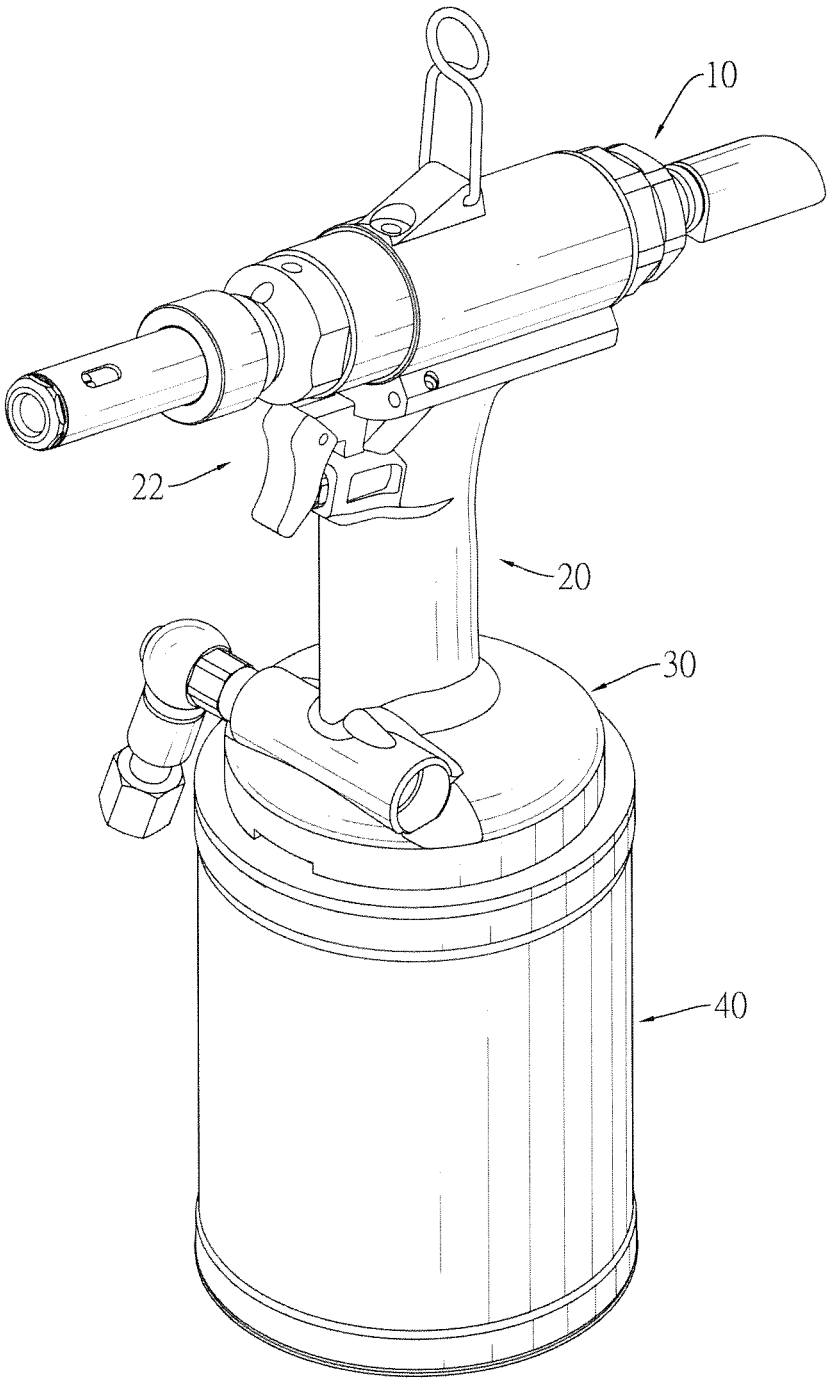
FIG. 1 is a perspective view of a rivet gun in accordance with the present invention.
Figure 2:
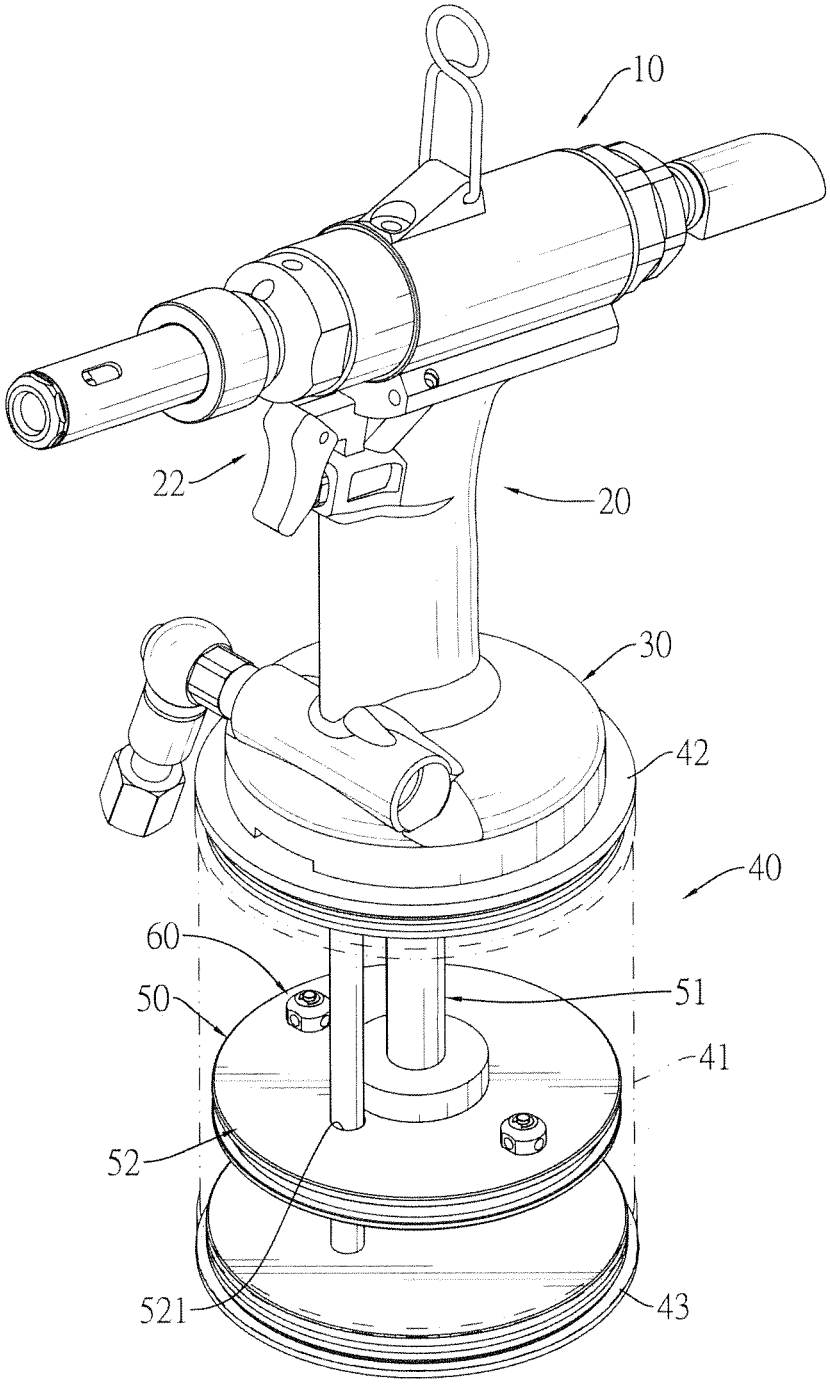
FIG. 2 is a perspective view of the rivet gun in FIG. 1 without an inflator housing.
Figure 3:
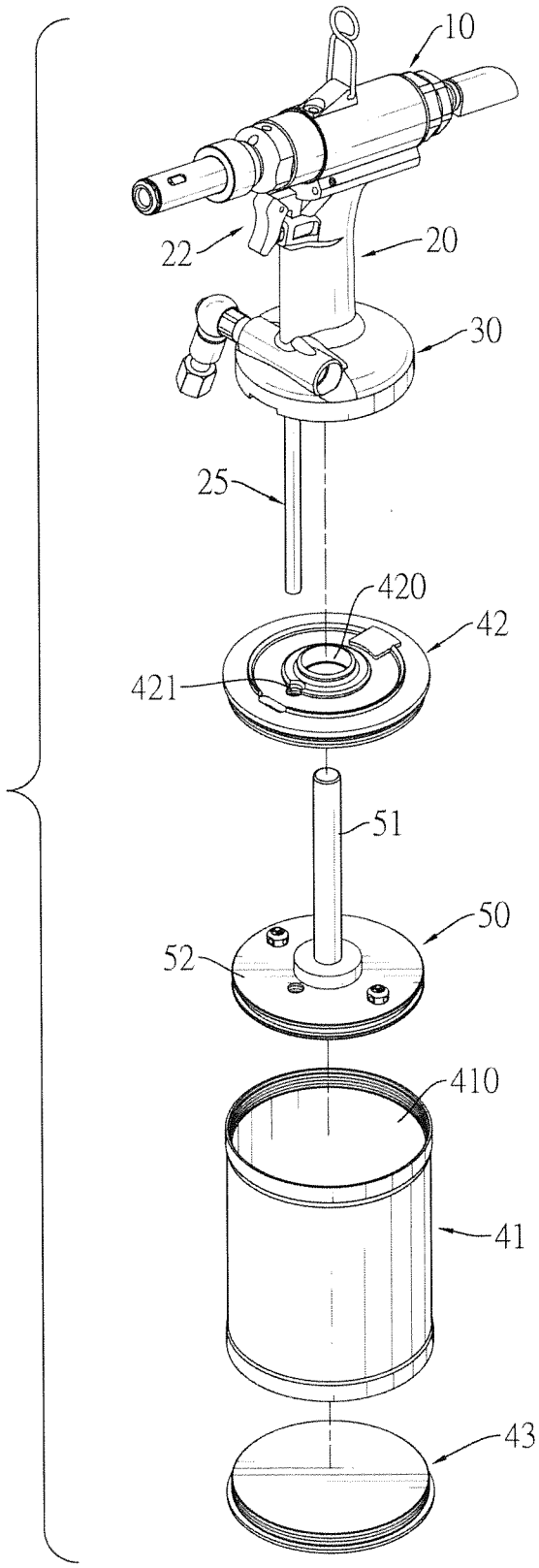
FIG. 3 is an exploded view of the rivet gun in FIG. 1.

With reference to FIGS. 1 to 3, a rivet gun in accordance with the present invention comprises a barrel 10, a handle 20, an annular mounting base 30, an inflator 40, a piston assembly 50 and two buffer devices 60.

The barrel 10 has a rivet assembly 11 mounted in the barrel 10.

Figure 6:
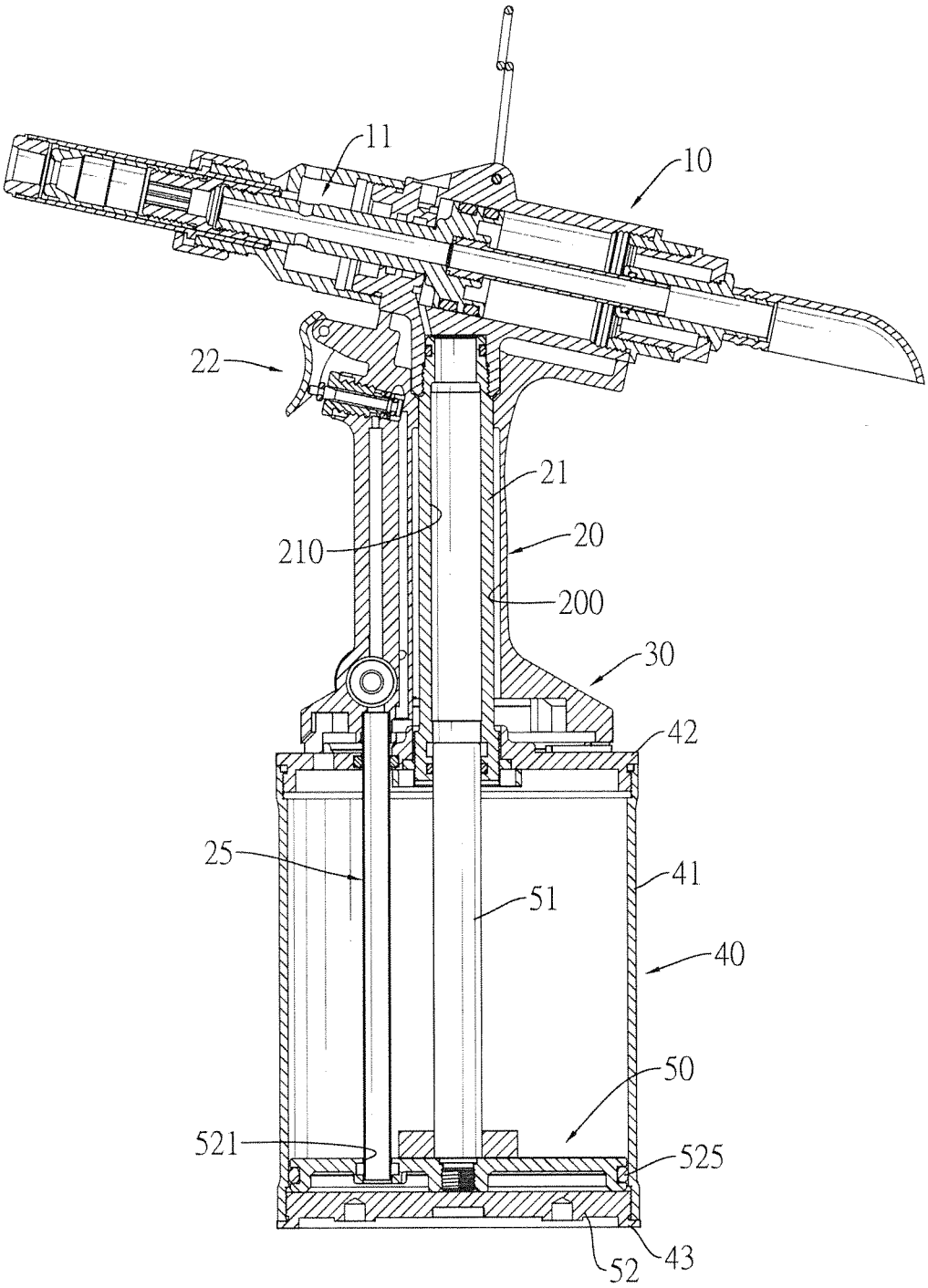
FIG. 6 is a side view in partial section of the rivet gun in FIG. 1.

With further reference to FIG. 6, the handle 20 extends downwards from the barrel 10 and has a trigger assembly 22, an accommodating space 200, a hydraulic pipe 21 and a connecting pipe 25. The trigger assembly 22 is mounted on the handle 20 to actuate the rivet assembly 11. The accommodating space 200 is formed in the handle 20 and the hydraulic pipe 21 is mounted in the accommodating space 200 with a hydraulic channel 210 formed in the hydraulic pipe 21. The connecting pipe 25 is mounted on a bottom of the handle 20.

The annular mounting base 30 extends outwards from the bottom of the handle 20.

The inflator 40 is mounted on a lower end of the hydraulic pipe 21, abuts the annular mounting base 30, allows the connecting pipe 25 to extend in the inflator 40 and has an air chamber 410. The air chamber 410 is formed in the inflator 40. In a preferred embodiment, the inflator 40 further comprises an inflator housing 41, a top cap 42 and a bottom base 43.

The inflator housing 41 has a top opening and a bottom opening both communicating with the air chamber 410. The top cap 42 is mounted on the top opening of the inflator housing 41 and abuts the annular mounting base 30.

The top cap 42 is also mounted on the lower end of the hydraulic pipe 21 and has a mounting hole 420 and a through hole 421. The mounting hole 420 is formed through the top cap 42 and the hydraulic pipe 21 extends through the mounting hole 420. The through hole 421 is formed through the top cap 42 and the connecting pipe 25 of the handle 20 extends through the through hole 421. The bottom base 43 is mounted on the bottom opening of the inflator housing 41.

Figure 4:
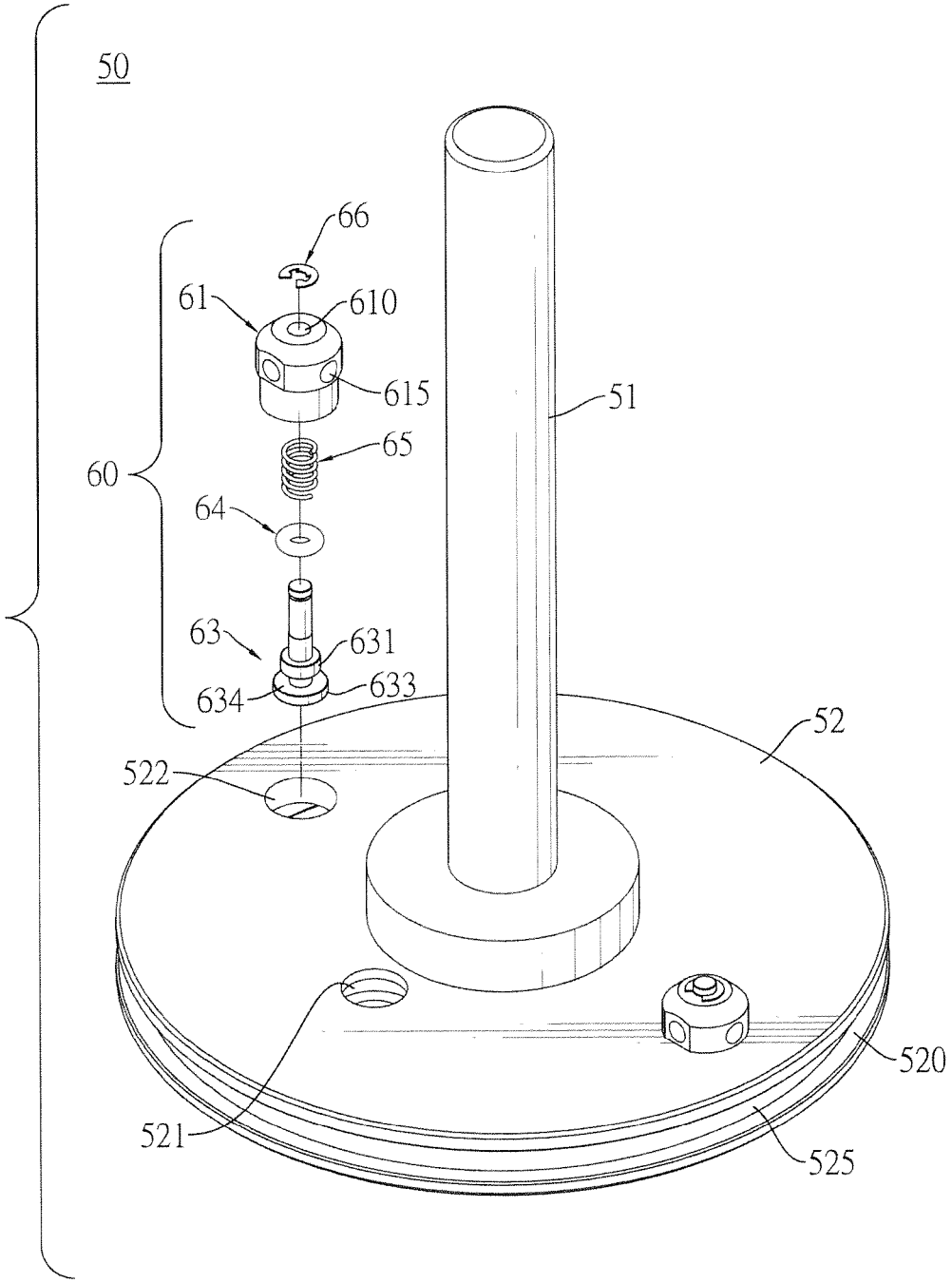
FIG. 4 is a partial exploded view of a piston assembly of the rivet gun in FIG. 1.
Figure 5:
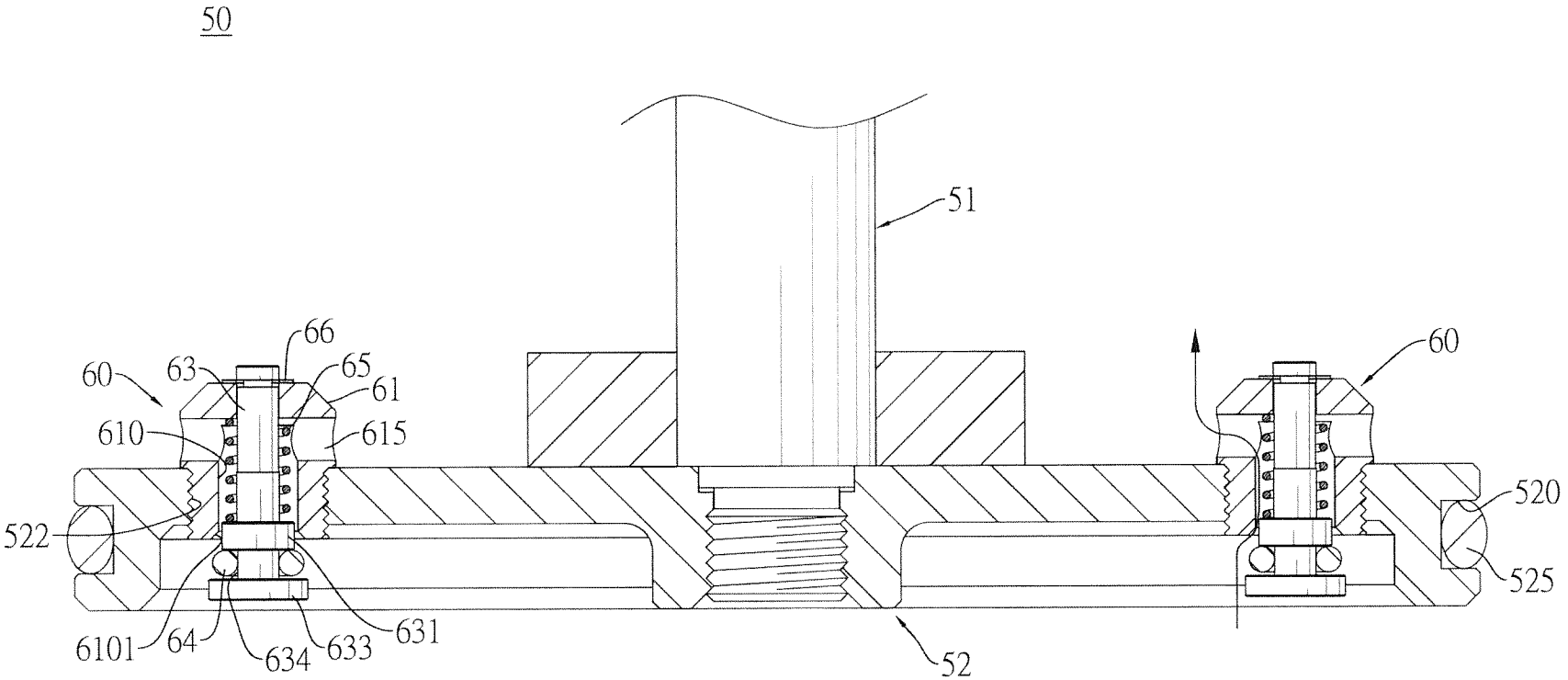
FIG. 5 is an enlarged front view in partial section of a buffer device of the rivet gun in FIG. 1.

With further reference to FIGS. 4 to 6, the piston assembly 50 is mounted in the inflator 40, and has a piston rod 51 and a piston head 52. The piston rod 51 is movably mounted in the hydraulic channel 210 of the hydraulic pipe 21 of the handle 20. The piston head 52 is disk-shaped and is mounted on a lower end of the piston rod 51. The piston head 52 airtightly contacts an inner wall of the air chamber 410 of the inflator 40, divides the air chamber 410 into an upper space 4101 and a lower space 4102 and has two combining holes 522, a connecting hole 521 and an annular notch 520. The combining holes 522 are formed through the piston head 52. The connecting hole 521 is also formed through the piston head 52 and the connecting pipe 25 extends through the connecting hole 521 to transport a high pressure gas from an external high pressure gas source to the lower space 4102 of the air chamber 410. The annular notch 520 is radially formed on the piston head 52 and has an airtight ring 525 mounted in the annular notch 520 to make the piston head 52 contact the inner wall of the air chamber 410 in an air tight manner.

The two buffer devices 60 are radially symmetric to each other and are respectively mounted in the two combining holes 522 of the piston head 52. Each buffer device 60 has a housing 61, a valve stem 63, a buffer spring 65 and a stopper 66.

The housing 61 has an inserting hole 610 and at least one side hole 615. The inserting hole 610 is axially formed through the housing 61 and has a valve opening 6101. The at least one side hole 615 is radially formed through the housing 61 and communicates with the inserting hole 610.

The valve stem 63 is movably mounted in the inserting hole 610 and has a valve part formed protruding radially and outwards from a lower end of the valve stem 63 to selectively close the valve opening 6101 of the inserting hole 610. In a preferred embodiment, the valve stem 63 further comprises an annular groove 634 and a valve airtight ring 64. The annular groove 634 is radially formed on the valve part. The valve airtight ring 64 is mounted in the annular groove 634 to make the valve part airtightly contact the valve opening 6101 of the inserting hole 610. The valve part further comprises a first radial flange 631 and a second radial flange 633. A diameter of the first radial flange 631 is shorter than a diameter of the inserting hole 610. A diameter of the second radial flange 633 is longer than the diameter of the inserting hole 610. The annular groove 634 is formed between the first radial flange 631 and the second radial flange 633.

The buffer spring 65 is mounted around the valve stem 63 and has two ends. One end of the buffer spring 65 abuts an inner wall of the inserting hole 610 and the other end abuts the first radial flange 631 of the valve part to open the valve opening 6101 in a default state of the rivet gun.

The stopper 66 is C-shaped, the stopper 66 is mounted on an upper end of the valve stem 63 and outside of the housing 61.

Figure 7:
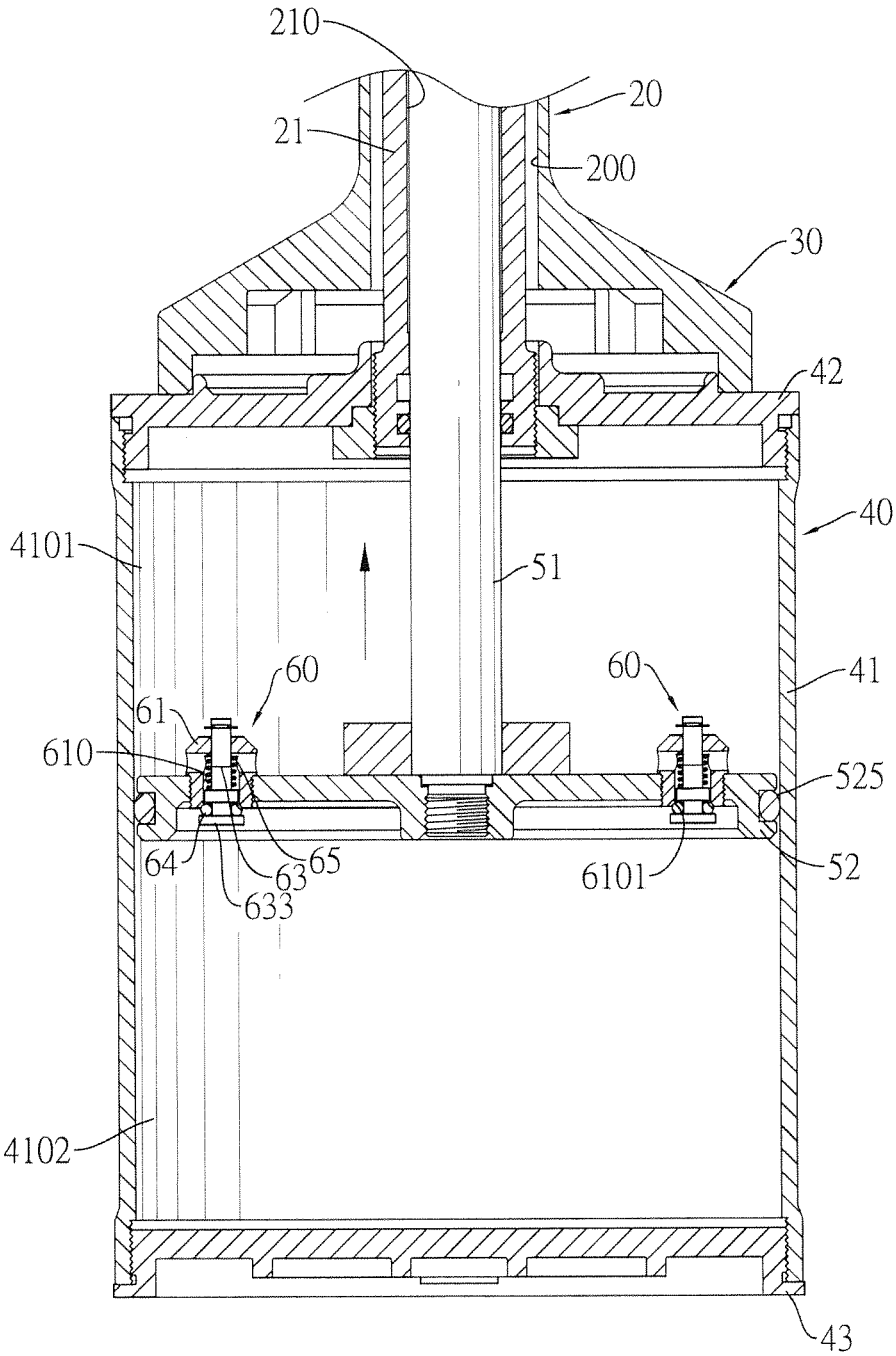
FIG. 7 is an enlarged operational front view in partial section of the rivet gun in FIG. 1.

With further reference to FIG. 7, when the lower space 4102 is filled with high pressure gas, the piston head 52 moves upward in the air chamber 410. The high pressure gas pushes the valve stems 63 of the two buffer devices 60 upward and presses against the buffer springs 65 to close the valve opening 6101 of the housing 61 by the valve part.

Figure 8:
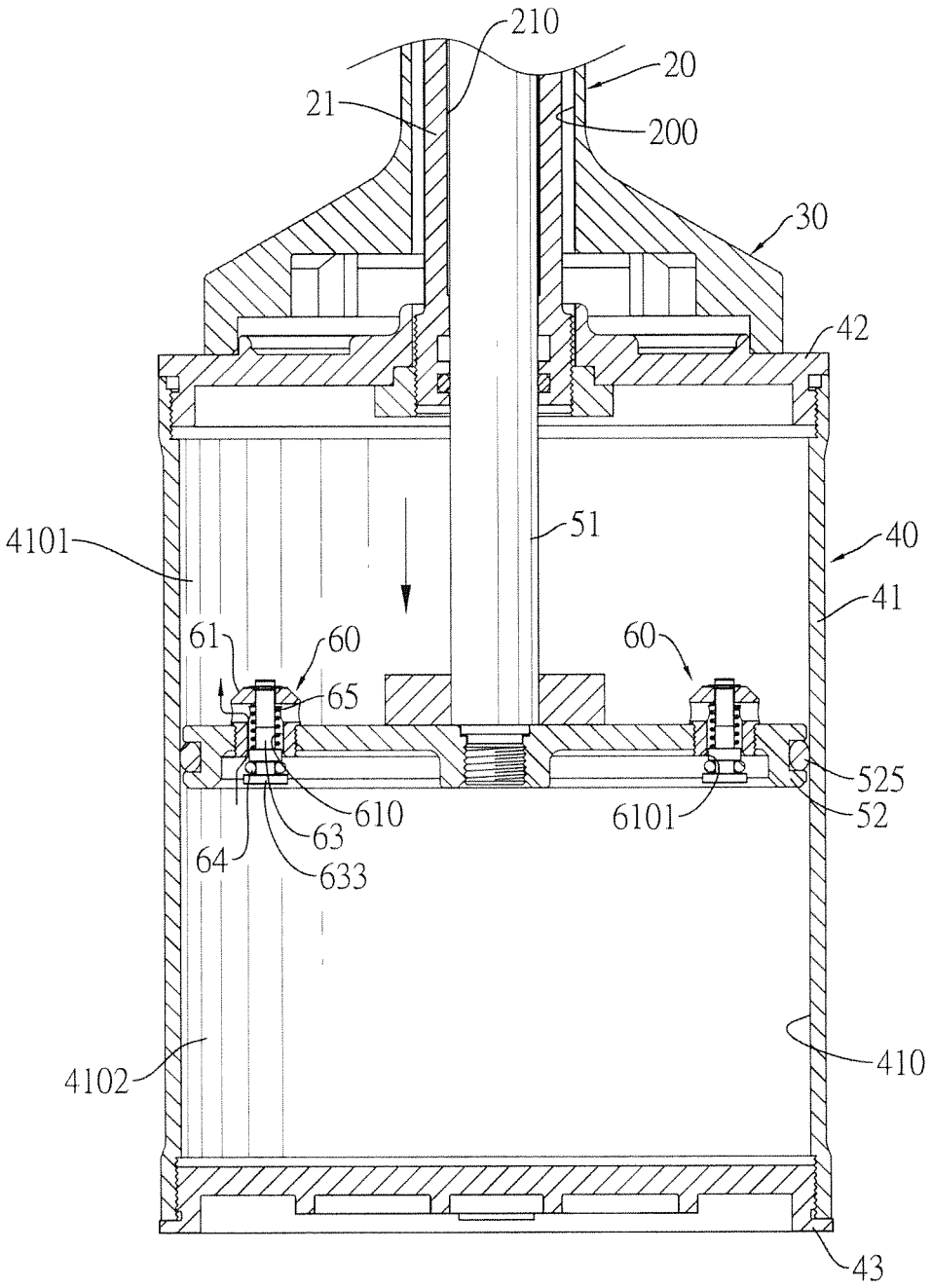
FIG. 8 is another enlarged operational front view in partial section of the rivet gun in FIG. 1.

With further reference to FIG. 8, when the piston head 52 moves downward in the air chamber 410, the valve stems 63 of the two buffer devices 60 also moves downward to open the valve opening 6101 of the housing 61 by the valve part and release the buffer springs 65, and further makes the upper space 4101 and the lower space 4102 communicate with each other.

By the above structure, the rivet gun in accordance with the present invention has the following advantages:

1. When the piston head 52 moves upward, the high pressure gas filled in the lower space 4101 has to press the buffer springs 65 to close the valve opening 6101 before pushing the piston head 52 upward. The buffer springs 65 partly absorb impact produced by the high pressure gas to mitigate shake caused by the high pressure gas directly hitting the piston head 52.

2. When the piston head 52 moves downward in the air chamber 410, the valve opening 6101 is opened and the buffer springs 65 are released to make the upper space 4101 and the lower space 4102 communicate with each other, such that the gas can freely enter the upper space 4101 or the lower space 4102 to make the piston head 52 move smoothly.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A rivet gun comprising:

a barrel having a rivet assembly mounted in the barrel;

a handle extending downwards from the barrel and having a trigger assembly to actuate the rivet assembly and having an accommodating space formed in the handle; and a hydraulic pipe mounted in the accommodating space and having a hydraulic channel formed in the hydraulic pipe;

an inflator mounted on a lower end of the hydraulic pipe and having an air chamber formed in the inflator:

a piston assembly mounted in the inflator, and having a piston rod movably mounted in the hydraulic channel of the hydraulic pipe; and a piston head being disk-shaped, mounted on a lower end of the piston rod, contacting an inner wall of the air chamber of the inflator in an air tight manner, dividing the air chamber into an upper space and a lower space and having at least one combining hole formed through the piston head;

at least one buffer device mounted in a corresponding combining hole of the piston assembly and having a housing having an inserting hole axially formed through the housing and having a valve opening; and at least one side hole radially formed through the housing and communicating with the inserting hole;

a valve stem movably mounted in the inserting hole and having a valve part formed radially and outwards from a lower end of the valve stem to selectively close the valve opening; and a buffer spring mounted around the valve stem and having two ends, one end of the buffer spring abutting an inner wall of the inserting hole and the other end abutting the valve part to open the valve opening in a default state of the rivet gun; and wherein when the lower space is filled with high pressure gas, the piston head moves upward in the air chamber, the high pressure gas pushes the valve stem of the at least one buffer device upward and presses against the buffer spring to close the valve opening of the housing by the valve part; when the piston head moves downward in the air chamber, the valve stem of the at least one buffer device also moves downward to open the valve opening of the housing by the valve part and release the buffer spring, and further makes the upper space and the lower space communicate with each other.

2. The rivet gun as claimed in claim 1, wherein the inflator further comprises:

an inflator housing having a top opening communicating with the air chamber; and a bottom opening communicating with the air chamber;

a top cap mounted between the top opening and the lower end of the hydraulic pipe;

a bottom base mounted on the bottom opening; and wherein when the piston head moves to a bottom of the air chamber of the inflator, the valve part of the at least one buffer device abuts the bottom base.

3. The rivet gun as claimed in claim 2, wherein the handle further comprises a connecting pipe extending into the inflator;

the piston head further comprises a connecting hole formed through the piston head for being inserted by the connecting pipe; and each one of the at least one buffer device has an annular groove radially formed on the valve part of the valve stem; and a valve airtight ring, mounted in the annular groove.

4. The rivet gun as claimed in claim 3, wherein the valve part further comprises:

a first radial flange, wherein a diameter of the first radial flange is shorter than a diameter of the inserting hole;

a second radial flange, wherein a diameter of the second radial flange is longer than the diameter of the inserting hole; and wherein the annular groove is formed between the first radial flange and the second radial flange.

5. The rivet gun as claimed in claim 1, wherein the piston assembly further comprises:

an annular notch radially formed on the piston head;

an airtight ring mounted in the annular notch to make the piston head contact the inner wall of the air chamber in an air tight manner.

6. The rivet gun as claimed in claim 4, wherein the piston assembly further comprises:

an annular notch radially formed on the piston head; and an airtight ring mounted in the annular notch to make the piston head contact the inner wall of the air chamber in an air tight manner.

7. The rivet gun as claimed in claim 5, wherein the valve stem further comprises:

a stopper mounted on an upper end of the valve stem and outside of the housing.

8. The rivet gun as claimed in claim 6, wherein the valve stem further comprises:

a stopper mounted on an upper end of the valve stem and outside of the housing.

9. The rivet gun as claimed in claim 7 comprising two buffer devices, wherein the piston head has two combining holes; and the two buffer devices are radially symmetric to each other and are respectively mounted in the two combining holes.

10. The rivet gun as claimed in claim 8 comprising two buffer devices, wherein the piston head has two combining holes; and the two buffer devices are radially symmetric to each other and are respectively mounted in the two combining holes.

11. The rivet gun as claimed in claim 2 further comprising:

an annular mounting base extending outwards from a bottom of the handle and abutting the top cap of the inflator.

12. The rivet gun as claimed in claim 3 further comprising:

an annular mounting base extending outwards from a bottom of the handle and abutting the top cap of the inflator.

13. The rivet gun as claimed in claim 4 further comprising:

an annular mounting base extending outwards from a bottom of the handle and abutting the top cap of the inflator.

14. The rivet gun as claimed in claim 10 further comprising:

an annular mounting base extending outwards from a bottom of the handle and abutting the top cap of the inflator.

* * * * *